US005080047A

United States Patent [19]

Williams et al.

[11] Patent Number: 5,080,047

[45] Date of Patent: Jan. 14, 1992

[54] CYCLIC DEMAND STEAM SUPPLY SYSTEM

[76] Inventors: Charles L. Williams, 850 S. Main St., Pocatello, Id. 83205; Eddy A. Williams, 911 Main St., P.O. Box 1217; Gary M. Vezzoso, 2709 W. Ustick Rd., both of, Caldwell, Id. 83605

[21] Appl. No.: 636,604

[22] Filed: Dec. 31, 1990

[51] Int. Cl.[5] ..... F22B 37/22

[52] U.S. Cl. ..... 122/35; 60/659

[58] Field of Search ..... 122/35, 36; 60/659

[56] References Cited

U.S. PATENT DOCUMENTS

| | | | |
|---|---|---|---|
| 1,682,624 | 8/1928 | Hedlund | 122/35 |
| 1,700,650 | 1/1929 | Wettstein | 122/35 |
| 4,556,018 | 12/1985 | Agata | 122/35 |

FOREIGN PATENT DOCUMENTS

| | | | |
|---|---|---|---|
| 246678 | 2/1926 | United Kingdom | 122/35 |

*Primary Examiner*—Edward G. Favors

*Attorney, Agent, or Firm*—Frank J. Dykas; Craig M. Korfanta; Ken J. Pedersen

[57] ABSTRACT

A steam system is disclosed having a steam boiler (14) designed to produce an adjustable supply of boiler steam and a steam accumulator (12) designed to supply all of the steam to steam load (66) as opposed to functioning as an auxiliary source to boiler (14). Steam accumulator (12) is a pressure vessel designed to function as a wet steam accumulator and sized to provide large quantities of steam in short bursts for a predetermined period of time to a sustained cyclic steam load (66) for a period of time sufficient to compensate for the time delays necessary to adjust the boiler steam produciton rate to equal changes in the average of the cyclic demand load. Accumulator (12) is formed of a pressurized vessel having a plurality of tubes (54) therein which are designed to have a sufficient heat transfer surface to transfer the majority of energy from boiler steam to the heated accumulator water (67) through conduction of heat through the tube heat transfer surfaces so that the majority of the boiler steam is actually condensed prior to being discharged into the heated accumulator water (67).

10 Claims, 7 Drawing Sheets

CYCLIC DEMAND STEAM SUPPLY SYSTEM

BACKGROUND OF THE INVENTION

1. Technical Field

This invention relates to an improved steam supply system for supplying steam to cyclic high demand steam loads. More particularly, it relates to a steam supply system for use in food processing steam applications.

2. Background Art

It is sufficient to say that steam boilers, generators and power systems have been in use for a long time and in a wide range of applications. Closed loop systems, wherein the expended steam is condensed and returned to the boiler, are used to generate electricity, to heat buildings, and even to propel nuclear powered submarines through the depths of the oceans. Open looped systems where the expended steam is discharged to the atmosphere have far fewer applications, and are generally used only in situations where the steam becomes contaminated during its use. One such application is the use of steam to peel bulk quantities of food products. The concept behind steam peeling is to place the food product into a vessel of some sort, rapidly introduce large quantities of steam for between 10 and 15 seconds in order to cook the surface skin of the food product without cooking the core or pulp of the food product.

There are a number of food products which can be steam peeled in this manner, they include, amongst others, tomatoes, cucumbers, carrots, beets, onions and potatoes. For purposes of this specification, steam peeling of potatoes will be used as an example, however the technology and information provided also applies to a wide variety of other food processing applications.

Potato processing is a rapidly growing and developing industry. In general terms, potatoes are harvested from the ground and stored, in bulk, in storages wherein temperature and humidity are closely controlled in order to maintain the potatoes in as close to original harvested condition as possible. Obviously the potatoes are still sheathed in protective skins. The first step in processing these stored potatoes into frozen french fries, hash browns, potatoes or the like, usually involves washing the whole potatoes to remove entrained dirt. After the potatoes are initially rinsed or washed, they are dropped, in bulk, into a peeling vat, which is a pressure vessel, having a large opening at the top. Once the vat has been filled with potatoes, the opening is sealed and saturated steam, usually at a temperature around 400° F. is injected into the vat peeler to rapidly cook the outer surfaces of the potato. Typically it takes approximately 0.08 pounds of steam at 400° F. per pound of potato for 15 seconds to impart a sufficient amount of heat to the surface of the potatoes to cook the skin without cooking the potato itself.

Once the potatoes have been cooked in the vat peeler for 15 to 20 seconds, the spent or dead steam is released to atmosphere, the vat peeler opened, and the potatoes dumped into some sort of a brushing device, or other apparatus where the cooked skins are separated from the potatoes. Then the peeled potatoes, in the typical processing operation, are again washed, cut into the desired pieces and further processed to produce the desired final product.

It is important to cook only the skin of the potato, and minimize cooking the potato pulp. Potatoes are expensive to grow and the inadvertent cooking of a few extra millimeters of the potato pulp, can result in a significant loss of product in a large processing operation and contribute to increased waste treatment load. As a result, it is desirable to introduce the steam into the batch peeler as quickly as possible, to hold it in the peeler for the precise, empirically determined, amount of time, and then to quickly expunge it from the peeler in order to only cook the surface peel of the potatoes.

For a single 900 pound potato peeler, what this means is supplying about 12,000 pounds per hour to 20,000 pounds per hour of steam at 400° F. and at approximately 250 p.s.i.a. for between 15 and 30 second periodic bursts and then drop to an effective zero demand for 50 to 120 seconds. Conventional packaged steam boilers are not designed to handle this cyclic steam demand.

The conventional steam boiler or steam generator uses fossil fuels, usually gas or oil, to boil water to make steam. They are not suitable for sustained cyclic operation with fast reaction times necessary to increase output 25% to 40% for 15 to 30 seconds and then reduce output by the same 25% to 40%. As a result, steam accumulators are sometimes used to store steam energy for use in the steam bursts needed for steam peeling processes. However, in the prior art, the designers of these steam supply systems for steam peelers have approached the problem and the use of the steam accumulator incorrectly which resulted in inefficient boiler operation and excessive peel loss. First, the accumulators have been connected into the steam supply systems as auxiliary sources of steam for the peelers. That is to say there is a direct piping connection between the steam boiler discharge line and the steam peeler to which the accumulator is also attached. Thus, in this conventional piping arrangement, when a burst of steam is introduced into the peeler, pressure in the boiler discharge line is rapidly decreased. Boiler controls respond by increasing firing rate and reducing feed water flow and to higher liquid levels in the boiler. These controls are normally slow reacting to preclude operation of the boiler outside its normal pressure and level band. In addition, when the boiler discharge pressure is rapidly drawn down as such, boiler pressure and steam accumulator pressure equalize for a period of time, which results in an inability to add or inject energy from the boiler into the accumulator, thus limiting the entire system's energy recharge time. This results in the requirement for oversized boilers in order to minimize the system recharge time so that rapid cycling or bursting of steam is possible. An example of such an accumulator design can be seen in HELLBORG, U.S. Pat. No. 1,896,308.

There are two types of accumulators which can be generally classified as dry accumulators and wet accumulators. A dry accumulator is merely a large pressurized vessel which holds only steam. Dry accumulators have limited applications and generally are not in use today because of their size and inefficiencies. The preferred accumulator design is the wet accumulator wherein steam is introduced into a much smaller pressurized vessel, and is condensed and held as saturated liquid at an elevated pressure and temperature. Then when steam demand draws down the pressure in the steam system, the heated accumulator water becomes super-heated in relation to the lowered pressure within the accumulator pressure vessel, and as a result flashes to steam and is delivered through the steam system to the steam load. An example can be seen in FÖHL, U.S.

Pat. No. 1,867,143, and in prior art FIG. 1 of this specification.

In prior art systems, boiler steam is injected directly into the accumulator water through steam spargers. The boiler steam passes through the distribution pipes and is sparged into the accumulator water where the thermal energy from the boiler steam is transferred to the water and the boiler steam is condensed. Typically the accumulator and the boiler steam discharge line are both interconnected to the same steam load, and the accumulator acts as an auxiliary source of steam when the load draws down the pressure in the common discharge line. When the accumulator is thus in use as an auxiliary steam source, both the boiler pressure and accumulator pressure are the same, thus no steam will flow from the boiler discharge into the accumulator.

In these prior art systems, as steam demand is reduced boiler discharge line pressure will again increase, and saturated water in the accumulator will stop flashing and the boiler will once again be able to commence recharging the accumulator. Thus there is an inherent time period during times of high steam demand and for a period of time thereafter when the boiler cannot recharge the accumulator. This time lag can be significant, and in practice has been found to be the limiting factor in some boiler and steam supply system design for food product steam peelers.

Another problem with conventional designs where the mechanism for the transfer of energy from the boiler steam to the accumulator water is sparging the gaseous steam through the accumulator water is that during draw down caused by high demand the sparging rate of boiler steam through accumulator condensate dramatically increases to the point where a gaseous path is created between the sparging point and the accumulator steam discharge point. In effect, the boiler steam forms its own pathway directly through the accumulator water, this reduces the rate of transfer of energy from the boiler steam to the accumulator water. In practice it has been found that this results in a poor distribution of injected thermal energy within the accumulator water to the point where there are cold and hot spots. This results in an additional increase in accumulator recharge time since convection flow must be reestablished within the accumulator for good mixing.

If the steam load is averaged over time, and it has a slow changing average load, as it is in food processing applications, then it would be better to have a steam supply system wherein the boiler is isolated from the pressure draw down resulting from cyclic load so that the boiler can operate in a steady state configuration. This would result in improved operation of the boiler and a more equal matching of boiler capacity to total average steam load, thus eliminating the need of oversized boilers.

Accordingly, it is an object of this invention to provide an open loop steam supply system wherein there is effective, but de facto, isolation of the boiler discharge line from the steam load. It is another object of this invention to provide an accumulator wherein the energy from the boiler steam is transferred to the accumulator water through conductive heat transfer surfaces of combination heat exchanger and sparge pipes as opposed to direct contact condensation of sparging boiler steam, thus eliminating the formation of gaseous pathways through the accumulator water during periods of high demand.

DISCLOSURE OF INVENTION

These objects are accomplished through use of a steam system having a steam boiler designed to produce an adjustably, but relatively constant, supply of boiler steam and a steam accumulator designed to supply all of the steam to the steam load as opposed to functioning as an auxiliary source to the boiler.

The steam accumulator is a pressure vessel designed to function as a wet steam accumulator and sized to provide large quantities of steam in short bursts for a predetermined period of time to a sustained cyclic steam load for a period of time sufficient to compensate for the time delays necessary to adjust the boiler steam production rate to equal changes in the average of the cyclic demand load. The accumulator is formed of a pressurized vessel having a plurality of tubes therein which are designed to have a sufficient heat transfer surface to transfer the majority of energy from boiler steam to the heated accumulator water through conduction of heat through the tube heat transfer surfaces so that the majority of the boiler steam is actually condensed prior to being discharged into the heated accumulator water.

Boiler steam is introduced into the accumulator through a boiler steam supply line to a sparge manifold and then into the sparge pipes, where its energy is transferred by conduction through the sparge pipe walls and the boiler steam is condensed. Boiler steam condensate collects at the lowermost ends of the pipes, where it is entrained in the remaining boiler steam and sparged through nozzles into the heated accumulator water. The sparging system and nozzles are sized such that boiler steam condensate can be continuously blown out of the sparge pipes with a small amount of sparging boiler steam but not such that the sparging steam will form, within system design parameters, a sparging, gaseous pathway through the heated accumulator water directly to the accumulator discharge steam pipe. Instead, the small amount of sparging boiler steam is used for the primary purpose of agitating the heated accumulator water, thus enhancing the rate of conductive heat transfer from boiler steam to the accumulator water, and minimizing recharge time.

A temperature sensor is provided for monitoring the temperature of the water within the accumulator. A flow meter is provided for monitoring the amount of boiler steam being supplied from the boiler to the accumulator sparge manifold, and a control circuit is provided to average the temperature of the heated accumulator water, thus enabling the production of a control signal proportional to the average steam demand placed upon the accumulator by a cyclic steam load such as a potato peeler. This average steam load signal is then compared to a signal produced by the boiler steam flow meter, and a output signal is generated, which in turn, is used to adjust a boiler steam discharge flow control valve to equalize the boiler steam output to the average steam load served by the accumulator.

BEST MODE FOR CARRYING OUT INVENTION

Figure 2:
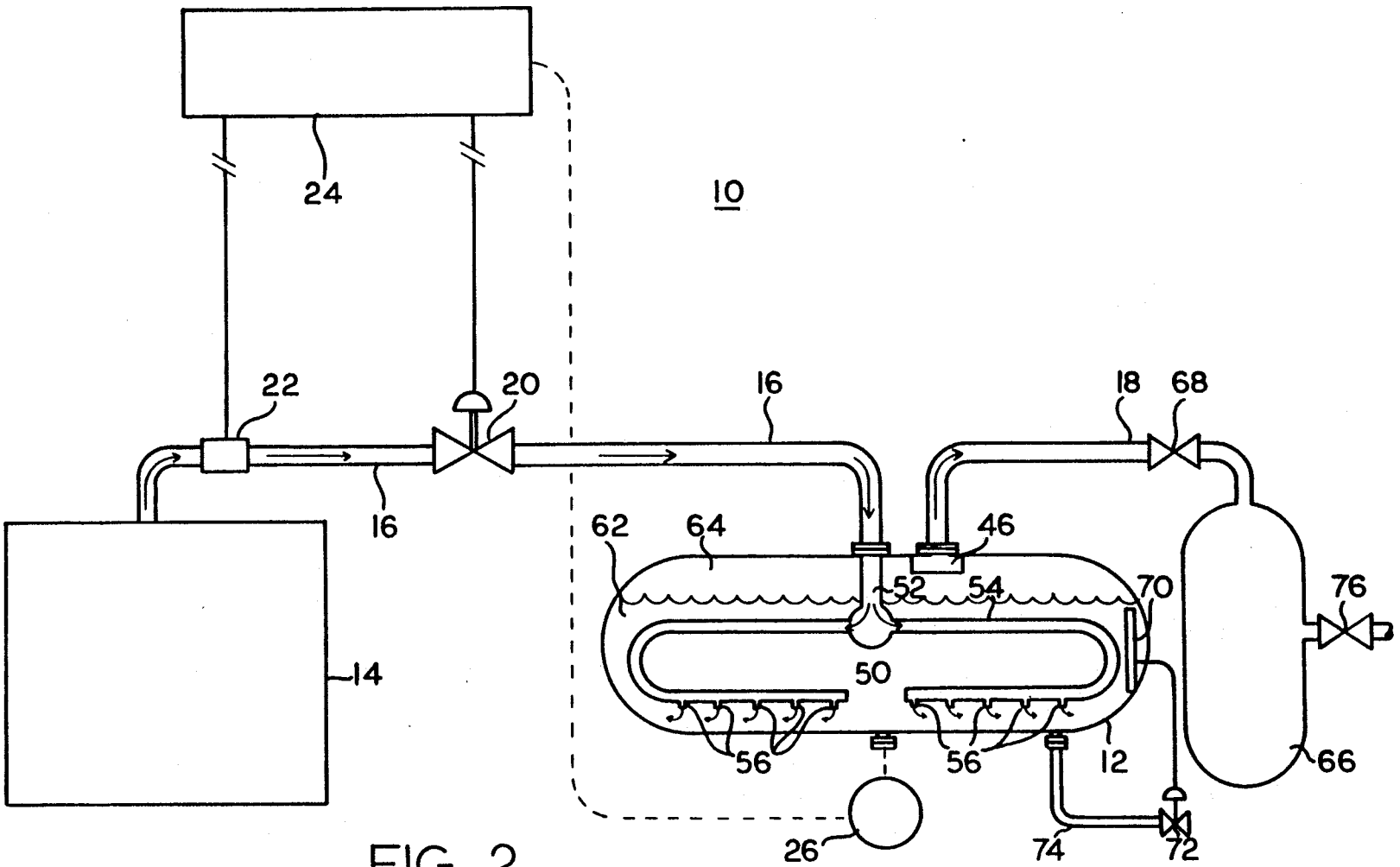
FIG. 2 is a schematic representation of my new steam supply system and first embodiment of the accumulator.

FIG. 2 discloses a schematic representation of my new steam supply system and the first embodiment of the accumulator design. It incorporates conventional boiler 14 which, in the preferred embodiment is a fossil fuel design preferably using natural gas or oil and is adjustable to produce saturated steam over a design capacity of 20,000 lbs./hr. to 80,000 lbs./hr. within the temperature pressure range of 381° F./200 pounds per square inch absolute, hereinafter p.s.i.a. to 417° F./300 p.s.i.a. which is supplied through boiler steam line 16 to the input of accumulator 12. Flow sensor 22 is provided in boiler steam line 16 and is temperature and pressure compensated to provide an output signal proportional to the quantity of boiler steam, in pounds per hour, passing through boiler steam line 16. Boiler steam flow is regulated by means of flow control valve 20.

Figure 6:
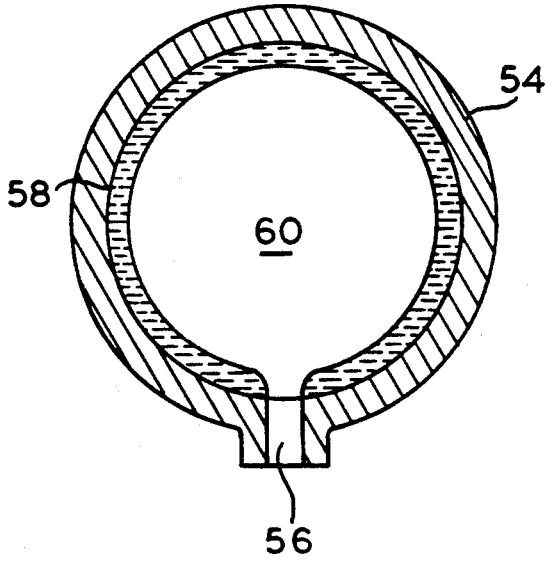
FIG. 6 is a sectional cross view of a combination heat transfer and sparging pipe.
Figure 7:
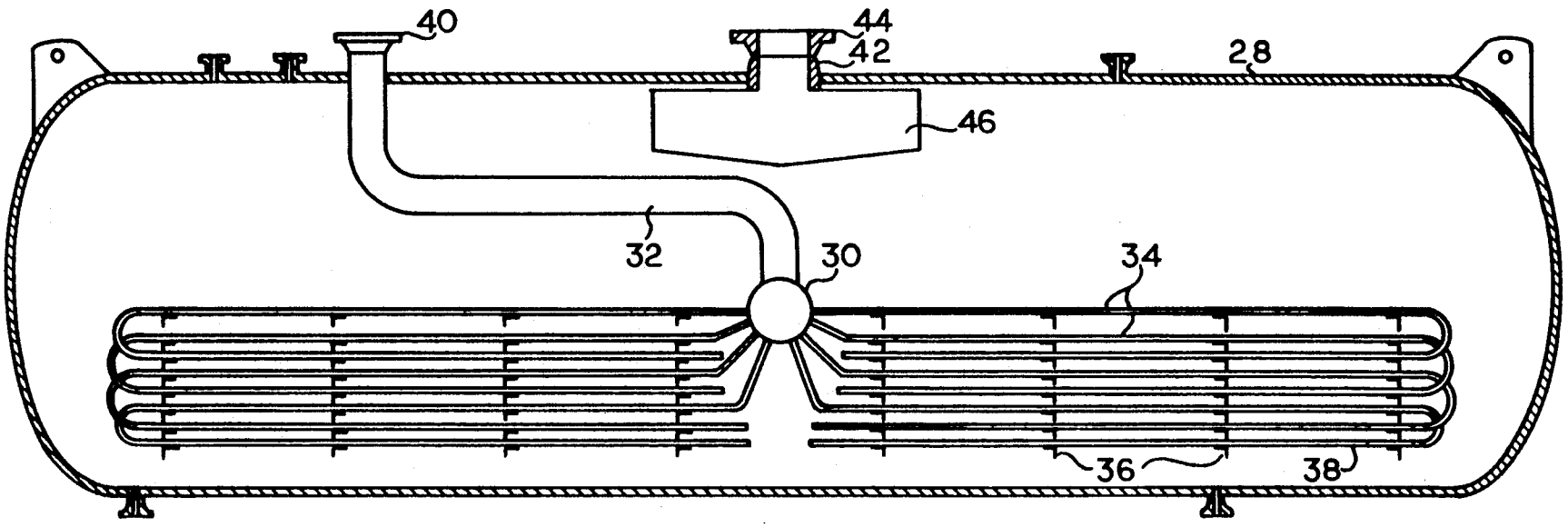
FIG. 7 is a sectional side view of the first embodiment of the new accumulator.

Accumulator 12 receives input boiler steam through boiler steam supply line 52 and sparge pipe manifold 50 to which is connected a plurality of sparge pipes 54, only two of which are shown in the schematic representation of FIG. 2. FIG. 6, is a sectional side view of the first preferred embodiment, as shown representationally in FIG. 2. It shows sparge manifold supply line 32, which is designed to be connected by means of supply line flange 40 to boiler steam line 16. Sparge manifold supply line 32 supplies boiler steam to sparge manifold 30. A plurality of bundled sparge pipes 34 are connected to sparge manifold 30, for receiving boiler steam. The plurality of sparge pipes 34 are held in place, in the bundle, by means of sparge pipe cradles 36. In both the sectional side view of the first embodiment of the accumulator, as shown in FIG. 6, and in the sectional representation of the accumulator as shown in FIG. 2, a plurality of sparging nozzles are provided for purposes of discharging some boiler steam and entrained boiler steam condensate into heated accumulator water 62.

Accumulator 12 is a pressurized vessel designed to contain heated accumulator water 62 in, at no load, equilibrium with accumulator steam 64. An open loop steam load 66 is representationally shown in FIG. 2 which is connected to accumulator 12 by means of accumulator steam line 18. When steam load 66 is brought on-line by opening steam load valve 68, steam flows from accumulator 12 to load 66, thereby causing a drop in pressure within accumulator 12, causing accumulator water 62, which was previously at saturated temperature and pressure with accumulator steam 64, to become super-heated with relation to the pressure of accumulator steam 64, thus causing accumulator water 62 to flash to steam. A conventional steam dryer 46 is provided to separate entrained accumulator water from steam 64 passing into accumulator steam line 18. There are a variety of conventional devices for separating saturated steam from entrained water and the design of steam separator 46 plays no part of the present invention.

When steam load 66 has been served with steam, for purposes of this description, steam load valve 68 is shut, and steam load dump valve 76 opened to exhaust the spent load steam to wherever it is desired, which can be a condenser in the event of a closed steam loop, or to atmosphere in the event of an opened steam loop.

As can be seen in FIG. 2, there is no direct plumbing or piping connection between steam boiler 14 and steam load 66. All steam for steam load 66 is drawn from the pocket of accumulator steam 64 found atop accumulator water 62 in accumulator 12.

Figure 1:
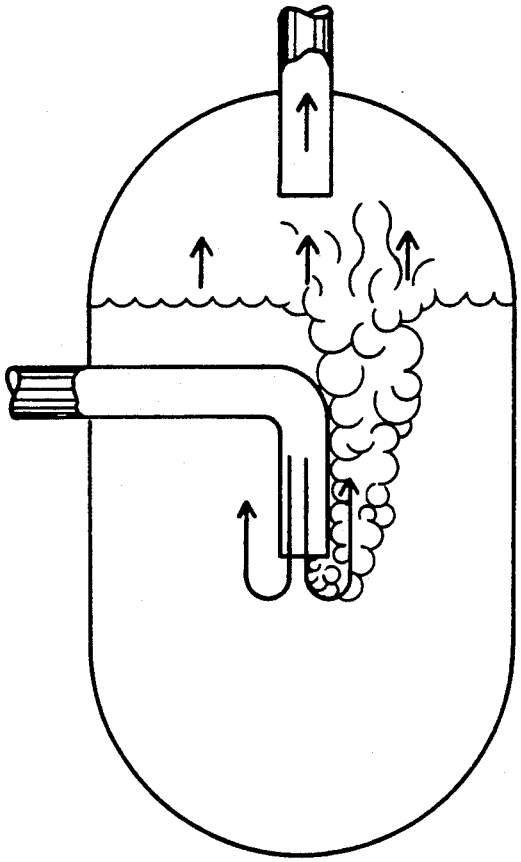
(PRIOR ART) FIG. 1
FIG. 1 is a schematic sectional representation of a sparging prior art steam generator.

As previously mentioned in other parts of this specification, and is shown in prior art FIG. 1, with conventional accumulators energy is transferred from the boiler steam to the accumulator water by means of sparging gaseous boiler steam through the accumulator water. And as also previously stated, and is shown in prior art FIG. 1, in times when there is a significant pressure differential between the sparging boiler steam, and the lowered pressure within the accumulator caused by high demand, this sparging can actually result in a gaseous vapor path between the discharge of the prior art sparge pipe, and the surface of the accumulator water. During such cases, there results, even if the boiler discharge line is not directly plumbed to the steam load, a direct gaseous path for boiler steam from the discharge of the boiler, through the accumulator water, to the steam load. This can result in a significant draw-down of boiler pressure from which it will take some period of time to recover once the size of the steam load is reduced.

Also, the rapid sparging of boiler steam into accumulator steam 64 actually repressurizes the accumulator thereby reducing the pressure differential between the boiler steam and the accumulator thus reducing the inflow of boiler steam into the accumulator when steam demand drops and thereby increases the recharge time for the accumulator.

It has been found in steam burst applications, such as those necessary for steam peeling of food products, that a cyclic load of 45,000 lbs./hr. of steam for 15 seconds, followed by a zero load for 45 seconds, would draw down the output temperature and pressure of steam boiler 14 as described herein, to a point where its output would reach equilibrium with the prior art accumulator, even if there were no draw-down of temperature and pressure caused by a direct plumbing connection between the boiler discharge and the steam load. As a result, it would require some recharge time for boiler 14 in order to develop sufficient discharge pressure to once again cause a flow of boiler steam into the prior art accumulator. And, without such flow of boiler steam into the prior art accumulator, there is no recharge of energy into the heated accumulator water.

Figure 5:
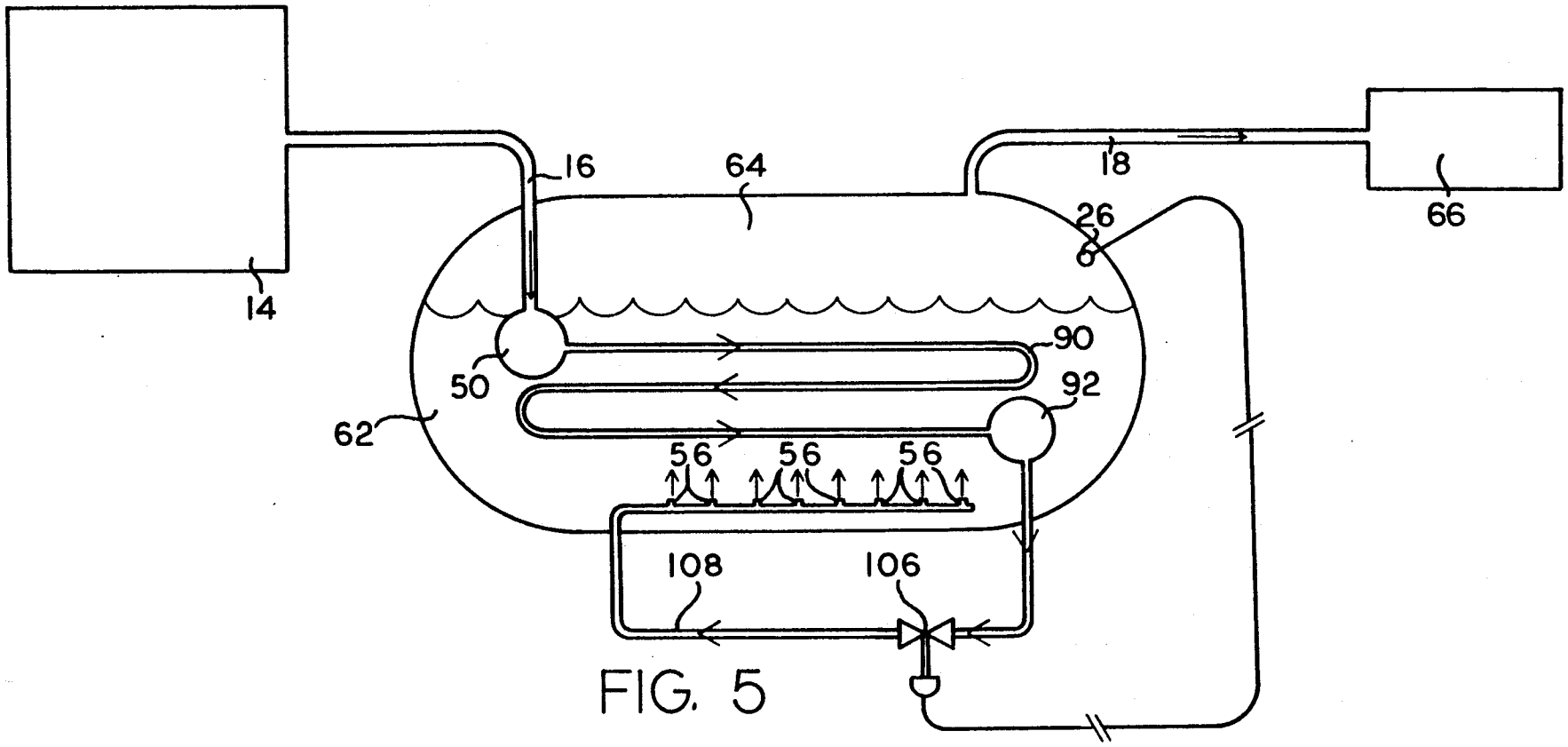
FIG. 5 is a schematic representation of a fourth embodiment of my new accumulator.

To prevent this delayed recharge time in cyclic steam burst applications, sparge pipe 54 of accumulator 12, as shown in FIGS. 2 and 5, is configured to transfer boiler steam energy from the boiler steam to the heated accumulator water by conductance through heat transfer surfaces of sparging pipe 54 as opposed to sparging gaseous steam directly into heated accumulator water 62. This is accomplished by use of a plurality of sparging nozzles 56 which function as a discharge throttle for sparging pipe 54 to insure that there is always a positive pressure differential between boiler steam 60 contained within sparging pipe 54 and heated accumulator water 62, thus insuring that there will always be a continuous input of energy from boiler steam 60 into heated accumulator water 62 in order to minimize recharge time. To insure that most of the energy is transferred from boiler steam 60 to heated accumulator water 62 by conductance, it has been found in practice that the heat transfer surface area formed from the sparge pipe walls of sparge pipes 54 to cross-sectional discharge barrier of sparging nozzles 56 is a minimum of 10,000 to 1 to insure at least a 6° F. temperature differential, hereinafter ΔT, between boiler steam and accumulator water during periods of no accumulator load demand and during periods of high accumulator load demand, at approximately 45,000 lbs./hr. for 15 seconds, an increase in the ΔT between the boiler steam when held within sparge pipes 54 and the accumulator water of 9.3° F. Hence, with a heat transfer to nozzle cross-sectional area ratio of at least 10,000 to 1, boiler 14 producing steam at 283 p.s.i.a. and 412° F. will, at all times, be able to provide energy input to accumulator 12 operating within a design range of 225 p.s.i.a. and 263 p.s.i.a.

In reality the steam saturation curve is nonlinear, however in practice, when designing a steam system with fairly loose but limited design parameters, it can be approximated by a straight line, and the following formula can be used to calculate the total heat transfer surface area for the sparging tubes:

$$A = \frac{.074 M_f}{\left(\frac{P_{HA} - P_{LA}}{P_S}\right)^{i}\left(P_S - \frac{P_{HA} + P_{LA}}{2}\right)}$$

where

A is the heat transfer area of the sparging tubes;

$M_f$ is the average mass flow rate of steam supplied in lbs/hr.;

$P_{HA}$ is the peak pressure in the accumulator pressure cycle;

$P_{LA}$ is the low pressure in the accumulator pressure cycle;

$P_s$ is the boiler steam pressure;

i is a factor of 0.8 to 1.0;

for the following design parameters:

$M_f$ is between 5,000 lbs/hr to 20,000 lbs/hr;

$P_{HA}$ is between 230 p.s.i.a. to 260 p.s.i.a.;

$P_{LA}$ is between 220 p.s.i.a. to 250 p.s.i.a.;

$P_s$ is between 240 p.s.i.a. to 280 p.s.i.a.

While this formula is not an exact mathematical model it is an approximation which in normal circumstances can be used to estimate the required heat transfer surface area for a commercial steam system. Obviously if the system design parameters are such that they provide little room for a margin error, then a more precise formula will be required or an actual testing prototype should be constructed.

As previously stated in this specification, it is the object of this invention to utilize steam boiler 14 in the steady state operation configuration to provide a supply of steam for periodic burst operation which, in this case, a 15 second burst of steam at the rate of 45,000 lbs./min. followed by 45 seconds with no demand, which would average out to an average demand of 11,250 lbs./hr. To compute this average, temperature sensor 26 is provided to monitor temperature of accumulator water. Said temperature sensor is electrically connected to flow control circuit 24, which is also electrically interconnected with flow sensor 22. Flow control circuit 24 can thus be used to integrate or otherwise average temperature within the accumulator over time and compare that signal with a signal derived from flow sensor 22 to determine the imbalance, if any, between boiler steam being supplied to accumulator 12 and accumulator steam 64 being drawn off to support the average of accumulator load 66, and to generate a corrective signal for boiler steam discharge throttle valve 20 to adjust the average load of boiler 14 to the average load of accumulator 12.

As is well known in the art, steam accumulator 12 is fitted with a drain line 74 which is opened and closed by attached accumulator water dump valve 72. Dump valve 72 is electrically controlled through a connection to accumulator water level sensor 70, which is located within accumulator 12. This sensor is designed to prevent the accumulator from filling with water and causing a hydraulic condition therein.

In a like manner a pressure sensor can be substituted for temperature sensors 26 since accumulator steam 64 is at saturation temperature and pressure and temperature are interrelated. In the case of use of a pressure sensor in lieu of temperature sensor 26, the interconnections can be mechanical, and in some manner simplified in that a pressure signal can be sent from the accumulator pressure sensor directly to control mechanisms for throttle valve 20.

Figure 3:
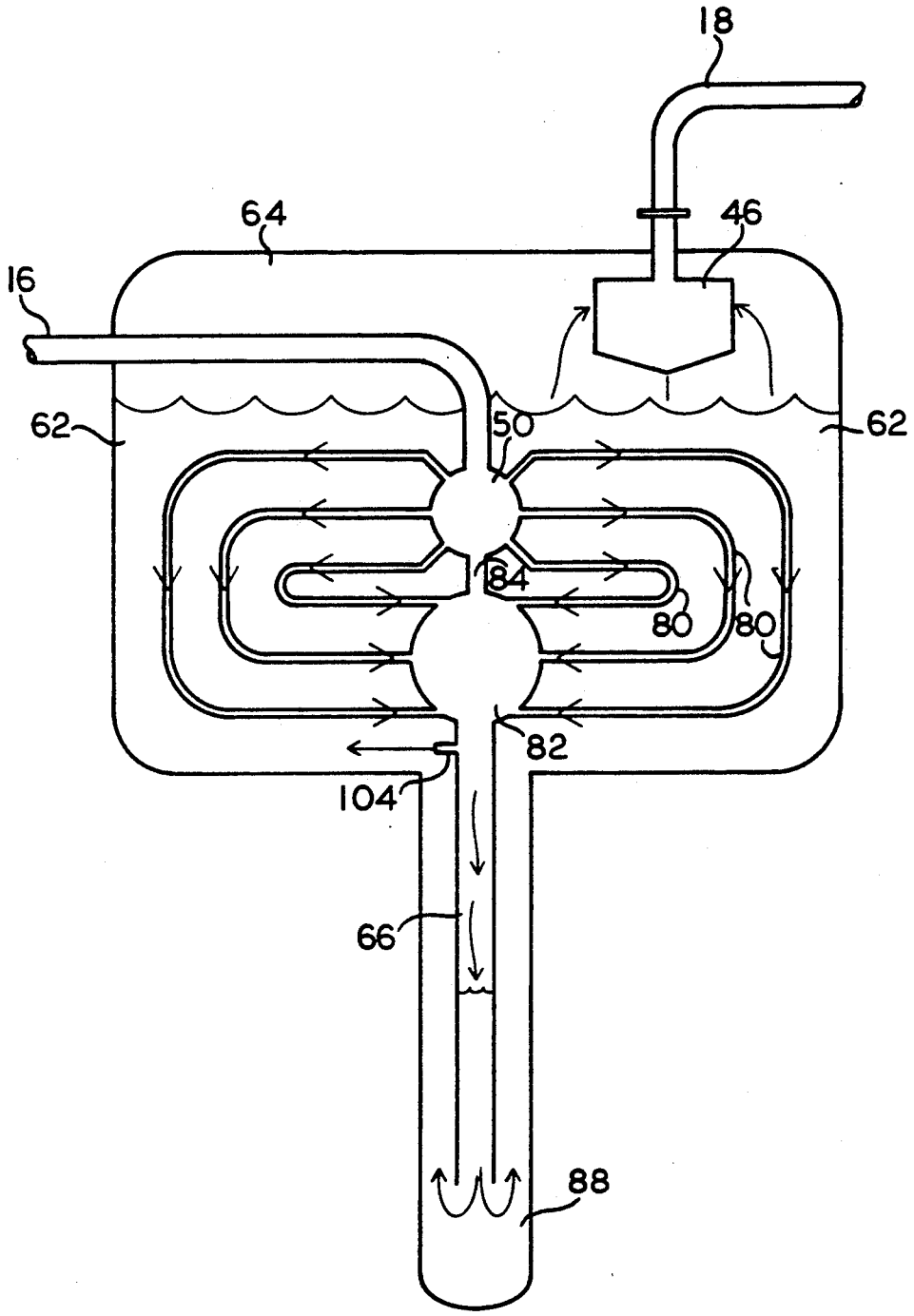
FIG. 3 is a schematic representation of a second embodiment of the steam accumulator.

A second embodiment for accumulator 12 is shown in FIG. 3. In this second embodiment the plurality of small sparging nozzles 56 are eliminated and instead, boiler steam condensate stand pipe 86 is provided. In this second embodiment, boiler steam flowing through boiler steam line 16 is dumped into sparge manifold 50 from where it is ported through a plurality of heat exchanger pipes 80 to condensate manifold 82. Overflow relief for excess capacity is provided by means of manifold cross connect pipe 84. In this embodiment, spent boiler steam and boiler steam condensate drain into stand pipe 86 and the condensate is eventually pushed out the open bottom of stand pipe 86 and into condensate well 88. Pressure differential modulations between the pressure of the supplied boiler steam and accumulator steam 64 are compensated for by use of stand pipe 86 with the boiler steam condensate water level being pushed down during periods of high demand, and rising up within stand pipe 86 during periods of low demand. Gas vent 104 is provided for venting non-condensable gases from boiler steam 16 to prevent their build-up in condensate manifold 82, which if not vented would result in the decrease in the ability to transfer energy from the boiler steam to accumulator water 62.

Figure 4:
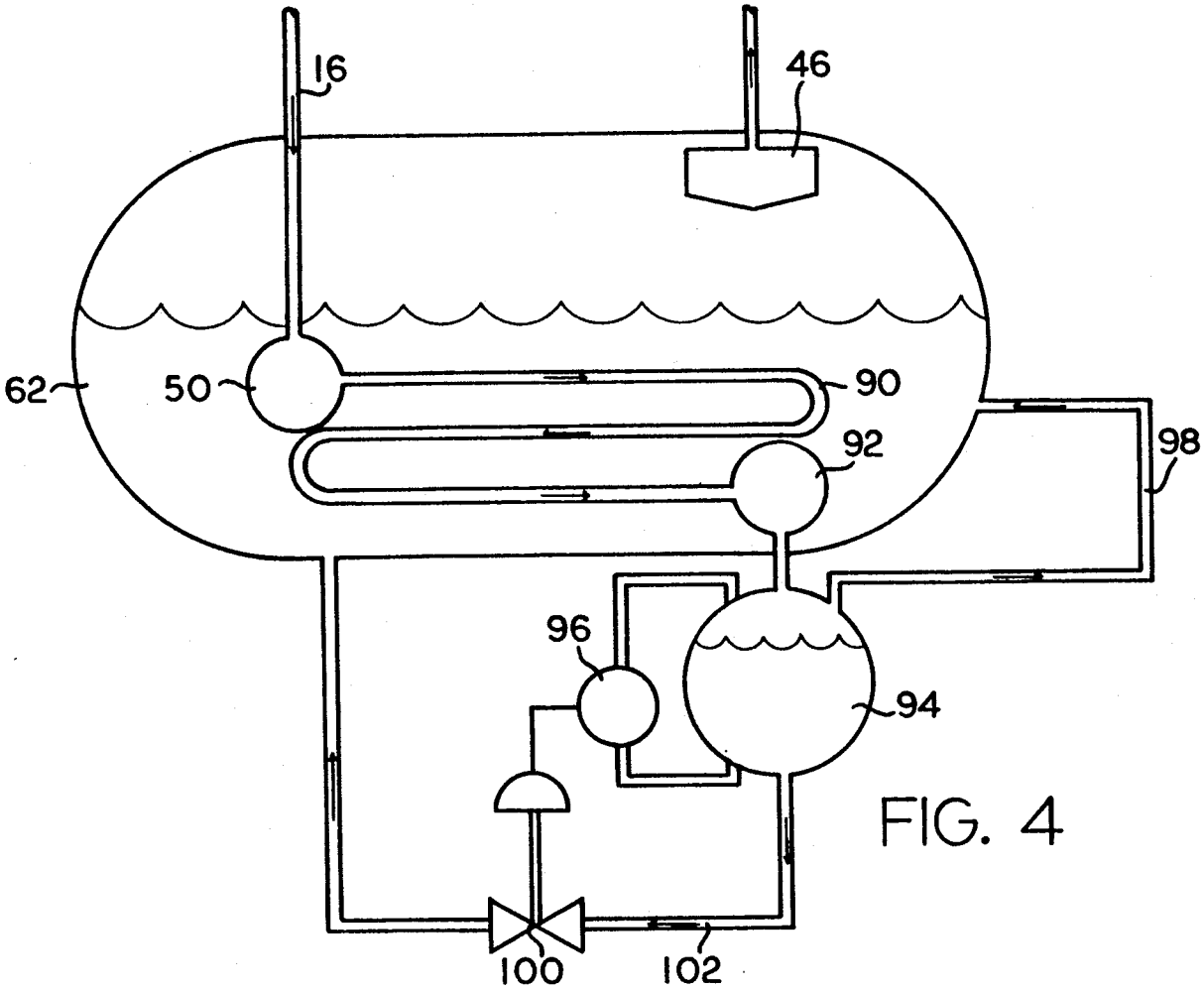
FIG. 4 is a schematic representation of a third embodiment of my new accumulator.

In a third embodiment, as shown in FIG. 4, boiler steam is again supplied through boiler steam supply line 16 to sparge manifold 50 and from there into a plurality of heat exchanger tubes 90, only one of which is shown in the schematic representation of FIG. 4. As in the case of the second embodiment shown in FIG. 3, spent boiler steam and entrained condensate are passed through heat exchanger tubes 90 to spent steam manifold 92 from where the boiler steam condensate drops into condensate vessel 94. Since there is a temperature differential between the boiler steam in heat exchanger tubes 90 and the surrounding accumulator water 62, and given the saturated conditions, this results in the fact that the pressure at which boiler steam condensate is held within condensate vessel 94 is always greater than that found within the accumulator, thus condensate level circuit 96 is provided to monitor the level of boiler steam condensate in condensate vessel 94, and as it reaches a high-end setpoint to open level control valve 100 to blow boiler steam condensate through condensate drain pipe 102 into the accumulator to recharge the supply of heated accumulator water.

In a fourth embodiment, instead of throttling the steam supply at the discharge of boiler 14, a sparge steam throttle valve 106 is provided to maintain a minimum back pressure within heat exchanger tubes 90, of which only one is representationally shown. In this embodiment, boiler steam is supplied through line 16 to sparge manifold 50 and from there into a plurality of heat exchanger tubes 90 which ultimately dump the steam to spent steam manifold 92. Temperature sensor 26 is provided to monitor the temperature and pressure within the accumulator, and sparge steam throttle valve 106 is controlled, by means of an input signal from temperature sensor 26, to maintain the pressure within the plurality of heat exchanger tubes 90 at an elevated point such that there is, given saturated steam conditions, a minimum $\Delta T$ of 9° F. between the boiler steam and accumulator water 62. Sparge steam throttle valve 106 is throttled to maintain this elevated pressure, with the spent boiler steam and entrained boiler steam condensate being throttled into sparge steam line 108 and ultimately out through nozzles 56.

While there is shown and described the present preferred embodiment of the invention, it is to be distinctly understood that this invention is not limited thereto but may be variously embodied to practice within the scope of the following claims.

What is claimed is:

1. A steam supply system for supplying a variably cyclic supply of steam to a steam load which comprises:

a boiler for producing an adjustably constant supply of boiler steam;

a steam accumulator for supplying accumulator steam to a cyclically variable steam load;

steam supply means for supplying steam produced by the boiler to the accumulator;

means for sensing the magnitude of the variable steam load on the accumulator;

means for averaging the variable steam load upon the accumulator over a preselected period of time; and means for adjusting the supply of boiler steam from the boiler to equal the average variable load upon the accumulator.

2. The steam supply system of claim 1 wherein the means for sensing the magnitude of the variable steam load on the accumulator is a temperature sensor for monitoring the temperature of heated accumulator water.

3. The steam supply system of claim 1 wherein the means for sensing the magnitude of the variable steam load on the accumulator is a pressure sensor for monitoring the pressure of the accumulator steam.

4. The steam supply system of claim 2 wherein the means for averaging the variable steam load upon the accumulator over a preselected period of time is an integrating circuit.

5. The steam supply system of claim 3 wherein the means for averaging the variable steam load upon the accumulator over a preselected period of time is an integrating circuit.

6. A steam accumulator for use with a steam boiler which comprises:

a pressure vessel for holding heated accumulator water and accumulator steam derived from the flashing of said heated accumulator water;

means for supplying boiler steam to a sparge manifold;

a sparging manifold for receiving boiler steam and distributing it to a plurality of sparge pipes;

a plurality of sparge pipes, having heat transfer surfaces for transferring heat energy from boiler steam to accumulator water, operatively connected to the sparge manifold for receiving boiler steam therefrom, said sparge pipes each having a plurality of sparging nozzles for discharging boiler steam and entrained condensate of boiler steam from said sparge pipe to the interior of the pressure vessel; and discharge means for removing accumulator steam from the pressure vessel.

7. The steam accumulator of claim 6 wherein the ratio of heat transfer surface of said sparge pipes to the cross-sectional area of the sparging nozzles is at least 10,000 to 1.

8. A steam accumulator for use with a steam boiler which comprises:

a pressure vessel for holding heated accumulator water and accumulator steam derived from the flashing of said heated accumulator water;

a downwardly extending accumulator water well extending downwardly from the bottom of said pressure vessel;

means for supplying boiler steam to an inlet distribution manifold positioned within the pressure vessel;

an inlet distribution manifold positioned within said pressure vessel;

a boiler steam condensate receiving manifold positioned within said accumulator;

a plurality of heat exchanger tubes operatively connected to said inlet and condensate manifolds for receiving boiler steam from said inlet manifold and transporting both it and boiler steam condensate into the condensate manifold;

a stand pipe operatively connected to the bottom of the condensate manifold and extending downwardly into the accumulator water well, said stand pipe being open at the bottom for passage of boiler steam condensate out from said stand pipe into the accumulator well; and discharge means for removing accumulator steam from the pressure vessel.

9. A steam accumulator for use with a steam boiler which comprises:

a pressure vessel for holding heated accumulator water and the accumulator steam derived from the flashing of said heated accumulator water;

a means for supplying boiler steam to an inlet manifold;

an inlet manifold disposed within said pressure vessel for receiving boiler steam;

a boiler steam condensate manifold positioned within said pressure vessel;

a plurality of heat exchanger tubes operatively connecting said inlet manifold and said boiler steam condensate manifold and for transferring the heat of boiler steam to the heated accumulator water within the pressure vessel;

a boiler steam condensate pressure vessel for receiving boiler steam condensate from the condensate manifold;

means for transferring boiler steam condensate from the pressure vessel to the accumulator pressure vessel; and discharge means for removing accumulator steam from the pressure vessel.

10. A steam accumulator for use with a steam boiler which comprises:

a pressure vessel for holding heated accumulator water and the accumulator steam derived from the flashing of said heated accumulator water;

a means for supplying boiler steam to an inlet manifold;

an inlet manifold disposed within said pressure vessel for receiving boiler steam;

a boiler steam condensate manifold positioned within said pressure vessel;

a plurality of heat exchanger tubes operatively connecting said inlet manifold and said boiler steam condensate manifold and for transferring the heat of boiler steam to the heated accumulator water within the pressure vessel;

a sparge manifold disposed within said pressure vessel, said sparge manifold further having a plurality of sparging nozzles for sparging boiler steam and entrained boiler steam condensate into the pressure vessel;

a sparge steam line operatively connecting the spent steam manifold to the sparging manifold;

a sparge steam throttle valve disposed within said sparge steam line for regulating pressure of the boiler steam at a point above the pressure of the accumulator water and accumulator steam held within the pressure vessel; and discharge means for removing accumulator steam from the pressure vessel.

* * * * *